US010799023B2

(12) United States Patent
Dinter et al.

(10) Patent No.: US 10,799,023 B2
(45) Date of Patent: Oct. 13, 2020

(54) HOUSEHOLD STORAGE APPLIANCE APPARATUS AND HOUSEHOLD STORAGE APPLIANCE

(71) Applicant: BSH HAUSGERAETE GMBH, Munich (DE)

(72) Inventors: Lars Dinter, Berlin (DE); Tien Bui, Geretsried (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/457,060

(22) Filed: Jun. 28, 2019

(65) Prior Publication Data

US 2020/0029686 A1 Jan. 30, 2020

(30) Foreign Application Priority Data

Jul. 25, 2018 (DE) ..... 10 2018 212 377

(51) Int. Cl.
*A47B 57/04* (2006.01)
*A47B 57/06* (2006.01)
*A47B 73/00* (2006.01)

(52) U.S. Cl.
CPC ..... *A47B 57/04* (2013.01); *A47B 57/06* (2013.01); *A47B 73/00* (2013.01)

(58) Field of Classification Search
CPC ..... A47F 57/04; A47F 57/06; A47F 57/30; A47F 73/00; A47F 5/04; A47F 3/04
USPC ..... 248/242, 243, 244
See application file for complete search history.

(56) References Cited

U.S. PATENT DOCUMENTS 3,161,159 A * 12/1964 Kritske ..... A47B 27/18 108/2
3,550,891 A * 12/1970 Scott ..... A47B 57/045 248/242
3,982,801 A * 9/1976 Heidorn ..... A47B 57/06 312/306
4,026,222 A * 5/1977 Mueller ..... A47B 9/14 108/146
4,791,873 A * 12/1988 Towfigh ..... A47B 5/04 108/10
4,934,645 A * 6/1990 Breslow ..... A47B 96/07 108/108
5,117,986 A * 6/1992 Lin ..... A47B 57/20 108/2
6,302,282 B1 * 10/2001 Gay ..... A47B 57/045 108/152
7,121,104 B2 * 10/2006 Howington ..... A47B 57/045 62/256
7,260,438 B2 * 8/2007 Caldwell ..... A47B 57/00 108/108
8,490,800 B2 * 7/2013 Noble Colin ..... A47F 5/12 211/150

(Continued)

*Primary Examiner* — Ko H Chan
(74) *Attorney, Agent, or Firm* — Laurence A. Greenberg; Werner H. Stemer; Ralph E. Locher

(57) ABSTRACT

A household storage appliance apparatus, in particular a household refrigeration appliance apparatus, includes at least one storage unit which has at least one storage element for holding at least one object. In order to provide improved storage, the storage unit has at least one inclination setting unit for changing at least one inclination of the storage element relative to a horizontal. A household storage appliance is also provided.

14 Claims, 4 Drawing Sheets

(56) References Cited

U.S. PATENT DOCUMENTS 8,950,603 B2 * 2/2015 Davis ..... A47B 57/00
108/108

* cited by examiner

HOUSEHOLD STORAGE APPLIANCE APPARATUS AND HOUSEHOLD STORAGE APPLIANCE

CROSS-REFERENCE TO RELATED APPLICATION

This application claims the priority, under 35 U.S.C. § 119, of German Patent Application DE 10 2018 212 377.2, filed Jul. 25, 2018; the prior application is herewith incorporated by reference in its entirety.

BACKGROUND OF THE INVENTION

Field of the Invention

The invention relates to a household storage appliance apparatus, in particular a household refrigeration appliance apparatus, including at least one storage unit which has at least one storage element for holding at least one object. The invention also relates to a household storage appliance including the apparatus.

Household storage appliance apparatuses, in particular cooled wine storage cabinets, with a number of storage units for storing wine bottles, are already known from the prior art.

SUMMARY OF THE INVENTION

It is accordingly an object of the invention to provide a household storage appliance apparatus and a household storage appliance, which overcome the hereinafore-mentioned disadvantages of the heretofore-known apparatuses and appliances of this general type and which have improved properties with respect to storage.

With the foregoing and other objects in view there is provided, in accordance with the invention, a household storage appliance apparatus, in particular a household refrigeration appliance apparatus, comprising at least one storage unit which has at least one storage element for holding at least one object. It is proposed that the storage unit has at least one inclination setting unit for changing at least one inclination of the storage element relative to a horizontal.

The inventive embodiment provides a generic apparatus with improved properties with respect to storage. It advantageously allows flexible wine storage, in particular for different types of wine. In particular an adjustable inclination allows different types of wine in particular to be stored advantageously. In particular it allows storage of bottles of different dimensions in particular, for example large bottles and/or magnums. In particular it allows optimum integration in kitchen facilities of standard dimension. It also allows a space-saving construction to be achieved. It is also possible to reduce production costs. A high level of operator convenience in particular can also be achieved. In particular the advantageous positioning of storage elements allows objects to be stored safely. It allows the flexible use of storage elements in particular. It also allows individual tailoring of storage conditions, for example storage temperature and/or storage position, in particular. In particular it allows an operator to organize the useful space in a flexible manner. Simple operation is advantageously possible. In particular it is possible to achieve advantageous positioning of items, for example wine bottles, for example for presentation purposes.

A "household storage appliance apparatus," in particular a household refrigeration appliance apparatus, refers in particular to at least one part, in particular a sub-assembly, of a household storage appliance in particular a household refrigeration appliance. In particular the household storage appliance is provided to store at least one object, in particular a food, in a temperature-controlled manner in at least one operating state and it preferably has at least one temperature control unit for setting at least one storage temperature for the object. A household storage appliance configured as a household refrigeration appliance is particularly advantageously provided to store chilled goods, in particular food such as beverages for example, in particular wine, as well as meat, fish, milk and/or dairy products, in particular to ensure a longer shelf life and/or appropriate temperature control for the chilled goods, and/or to store objects, in particular containers for holding chilled goods, in particular beverages, for example bottles, in particular wine bottles, glasses, in particular wine glasses and/or decanters and/or to ensure appropriate temperature control for the objects, in the at least one operating state. The household storage appliance configured as a household refrigeration appliance can be in particular a refrigerator or freezer, advantageously a beverage storage cabinet, particularly advantageously a wine storage cabinet. Alternatively the household storage appliance could be configured as a warming appliance and/or food warmer and/or a drying appliance and/or dehydrator.

A "storage unit" refers in particular to a unit, which has at least one storage element and which is provided to hold and/or position at least one chilled goods item and/or an object, in particular a wine bottle, in particular to set a position height and/or inclination of the chilled goods and/or object in a flexible manner. For example the storage unit can be configured as a shelf, advantageously as a tray, particularly advantageously as a height-adjustable and/or inclination-adjustable tray.

A "storage element" refers in particular to an element with at least one storage surface, which is provided to hold at least one object, it being possible for objects, in particular wine bottles, wine glasses and/or decanters to be positioned, upright or lying down, on the storage surface.

An "inclination setting unit" refers in particular to a unit for changing at least one inclination of the storage element, in particular in relation to a horizontal, in particular in at least one operating state of the household storage appliance. In particular the inclination setting unit can set the inclination of the storage element in stages. In particular the inclination setting unit can be actuated manually. A "horizontal" refers in particular to a plane, which is aligned at right angles to a vertical direction, in particular at least substantially parallel to an installation surface of the household storage appliance.

"At least substantially" in this context means in particular that a deviation from a predefined value is in particular less than 25%, preferably less than 10% and particularly preferably less than 5% of the predefined value.

"Provided" means in particular specifically programmed, constructed and/or equipped. That an object is provided for a specific function means in particular that the object satisfies and/or performs that specific function in at least one application and/or operating state.

It is also proposed that the household storage appliance apparatus has an appliance body or carcass, which defines a useful space and on or in which the storage unit is disposed. This allows an advantageous useful space construction to be achieved. An "appliance body" refers in particular to a unit, which, in at least one operating state, at least partially, in particular at least largely, forms an outer housing, in particular an outer housing of a household storage appliance apparatus, in particular of a household storage appliance, and which, in the operating state, partially, advantageously at least largely, defines an outer boundary at least of the useful space, in particular of a cooling chamber and/or a storage chamber. The expression "at least largely" in this case means in particular at least 55%, advantageously at least 65%, preferably at least 75%, particularly preferably at least 85% and particularly advantageously at least 95%. A "useful space" refers in particular to a space, in particular in a household storage appliance apparatus, in particular a household storage appliance, which holds and/or stores chilled goods and/or an object in at least one operating state.

It is further proposed that the inclination setting unit has at least one bearing unit, which defines at least one bearing axis, about which the storage element is rotatably supported. It allows in particular the definition of a fixed rotation axis of the storage element. This ensures safe operation in particular. In particular the storage element can be disposed on the appliance body by using the bearing unit. The bearing unit advantageously absorbs the force of the weight of the storage element and chilled goods and/or objects disposed on the storage element and transfers it in particular to the appliance body. In particular the bearing unit is disposed on the appliance body and connected to the appliance body by using a form-locking and/or force-locking connection. In particular the bearing unit can be connected to the storage unit at least partially as a single piece. That two units are configured "at least partially as a single piece" means in particular that the units have at least one, in particular at least two, advantageously at least three, common elements, which are a part, in particular a functionally important part, of both units. In particular the bearing axis is aligned parallel to a main extension plane of the storage element. A "main extension plane" of the storage element refers in particular to a plane, which is parallel to a largest side face of a smallest imaginary cuboid, which still completely contains the storage element, and in particular runs through the center point of the cuboid. The bearing axis preferably lies within the smallest imaginary cuboid. The bearing axis advantageously runs parallel to an, in particular longest, edge of the smallest imaginary cuboid. The bearing axis in particular runs above a center of gravity of the storage element.

It is further proposed that the bearing unit has at least one fastening element for fastening the storage unit to the appliance body. This in particular allows a stable structure to be achieved. In particular the fastening element has at least one toothed wheel, which can be disposed on a toothed rack of the appliance body in at least one operating state. In particular the fastening element has at least one guide element, which can be disposed at least partially in a corresponding guide rail of the appliance body in at least one operating state. In particular the fastening element fastens the storage unit to the appliance body by using a form-locking connection and/or by using a force-locking connection in at least one operating state. In particular the fastening element and in particular the storage unit can be displaced in at least one direction in relation to a vertical in particular by using a rotational movement of the toothed wheel along the toothed rack. In particular the bearing unit is disposed on a side wall of the appliance body. A "side wall" of an appliance body refers in particular to a vertical part of the outer housing, which is oriented at least substantially perpendicular to an operating face of a household storage appliance apparatus. An "operating face" of a household storage appliance apparatus refers in particular to a side of the household storage appliance apparatus facing the operator during an operating process in at least one operating state. The household storage appliance apparatus can in particular have an appliance door, which is disposed in particular on the appliance body on the operating face. In particular the operating face defines a front face of the household storage appliance apparatus.

It is further proposed that the bearing axis can be disposed on the appliance body in at least two different height positions by using the fastening element. This allows flexible heightwise positioning in particular to be achieved. Different height positions of the bearing axis can be set in particular by using a rack and pinion. A "height position" of a unit refers in particular to a position of the unit in relation to a vertical in particular in at least one operating state. In particular heightwise positioning is performed manually. Alternatively or additionally heightwise positioning can take place with electrical control. The bearing axis is advantageously disposed at maximum two points on the appliance body. This in particular allows a compact construction to be achieved.

It is also proposed that the inclination setting unit has at least at least one inclination setting element for determining an angle of inclination of the storage element. This in particular allows a storage element inclination to be set in a user-specific manner. An "angle of inclination" refers in particular to an angle between a surface normal of the main extension plane of the storage element and a further surface normal of the horizontal.

It is further proposed that the inclination setting element is configured at least partially as being disk-shaped. This in particular allows a space-saving construction to be achieved. The inclination setting element is advantageously disposed on the storage unit in such a manner that it cannot rotate about the bearing axis. In particular the inclination setting element is connected to the bearing unit by using a form-locking connection and/or force-locking connection. In particular a main extension plane of the inclination setting element is aligned perpendicular to the main extension plane of the storage element.

Particularly flexible inclination setting can be achieved, if the inclination setting element has at least one toothed wheel segment. The toothed wheel segment is advantageously configured as a single part with the inclination setting element. "As a single part" means in particular formed in one piece. This one piece is preferably produced from a single workpiece, mass and/or casting, particularly preferably in an injection molding procedure, in particular a single and/or multiple component injection molding procedure. In particular the toothed wheel segment is disposed on a periphery of the inclination setting element. The toothed wheel segment advantageously takes up a portion of the periphery in particular less than 50%, advantageously less than 40%, particularly advantageously less than 30% of the periphery of the inclination setting element. In particular the number of teeth of the toothed wheel segment per unit of angle advantageously determines the fine adjustment of the inclination setting.

It is further proposed that the inclination setting unit has at least one fixing unit for fixing the storage element at the angle of inclination, which interacts with the inclination setting element in at least one operating state. This allows in particular safe positioning, in particular safe inclination setting, for the storage element. In particular the fixing unit can be actuated one-dimensionally in an actuation direction. In particular the actuation direction is aligned parallel to the main extension plane of the storage element, advantageously along an edge of the smallest imaginary cuboid. In particular the fixing unit is supported in such a manner that it can be moved relative to the storage element.

It is also proposed that the fixing unit has at least one form-locking element for establishing and/or canceling a form-locking connection, at least partially interacting with the inclination setting element in at least one operating state. This allows simple positioning, in particular simple inclination setting. The form-locking element is advantageously configured as a latching lug. In particular the form-locking element engages in a gap between the teeth of the toothed wheel segment of the inclination setting element in at least one operating state. In particular the fixing unit is disposed on the storage unit by using a form-locking connection.

It is also proposed that the fixing unit has an operating element, which is connected to the form-locking element. This allows simple operation in particular. The form-locking element and the operating element are advantageously configured at least partially as a single piece with one another. In particular "as a single piece" in this case also means as a single part. In particular the operating element can be actuated manually and is configured in particular as a grip. The operating element can advantageously be moved in the actuation direction.

It is also proposed that the operating element can be operated by a displacement movement in at least one direction. This particularly advantageously allows easy operation. In particular the displacement movement is in the actuation direction. In particular the actuation direction is at least substantially in the direction of an operator in at least one operating state of the storage unit. In particular the operating element has a rest position, in which a form-locking connection is established between the form-locking element and the inclination setting element. In particular the operating element has at least one deflection position, from which the operating element can be deflected by using the displacement movement and in which the form-locking connection between the form-locking element and the inclination setting element is canceled.

It is also proposed that the fixing unit has at least one reset element which counteracts the displacement movement in at least one operating state. This in particular improves operating safety. It also in particular allows sensory feedback to the user with respect to actuation of the actuation element. In particular the reset element has a spring element. The reset element is advantageously pretensioned when the operating element is in the rest position. In particular the reset element has greater tension than the pretensioning in the deflection position. After an operating process the reset element advantageously moves the operating element into the starting position, in which there is in particular a form-locking connection between the form-locking element and the inclination setting element.

It is also proposed that the inclination setting unit is provided to set positive and negative angles of inclination. This in particular allows need-based and/or flexible support. In particular the angle of inclination can have a value of 0°, with which the storage element is horizontal. In particular the storage surface of the storage element can face the user and/or face away from the user. It is advantageously possible to set different sizes of inclination for the storage element.

It is also proposed that the household storage appliance apparatus has at least one functional overlay element for laying on the storage element. This in particular allows easy support. A "functional overlay element" refers in particular to an overlay element, which interacts with and/or influences chilled goods and/or objects in contact with the overlay element in at least one operating state. For example the functional overlay element can control the temperature of the chilled goods and/or object, in particular fastening them/it to the overlay element by using a form-locking connection and/or determining at least one object parameter, for example the shelf life and/or storage time of an object, by using a sensor element. In particular the functional overlay element can be configured as a mat and/or bottle holder.

With the objects of the invention in view, there is concomitantly provided a household storage appliance, in particular a household refrigeration appliance and preferably a wine storage cabinet, comprising a household storage appliance apparatus, which allows in particular advantageous storage, in particular for wine bottles.

The household storage appliance in this case is not limited to the application and embodiment described above. In particular the household storage appliance can have a number of individual elements, components and units that is different from a number cited herein to bring about a mode of operation described herein.

Other features which are considered as characteristic for the invention are set forth in the appended claims.

Although the invention is illustrated and described herein as embodied in a household storage appliance apparatus and a household storage appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
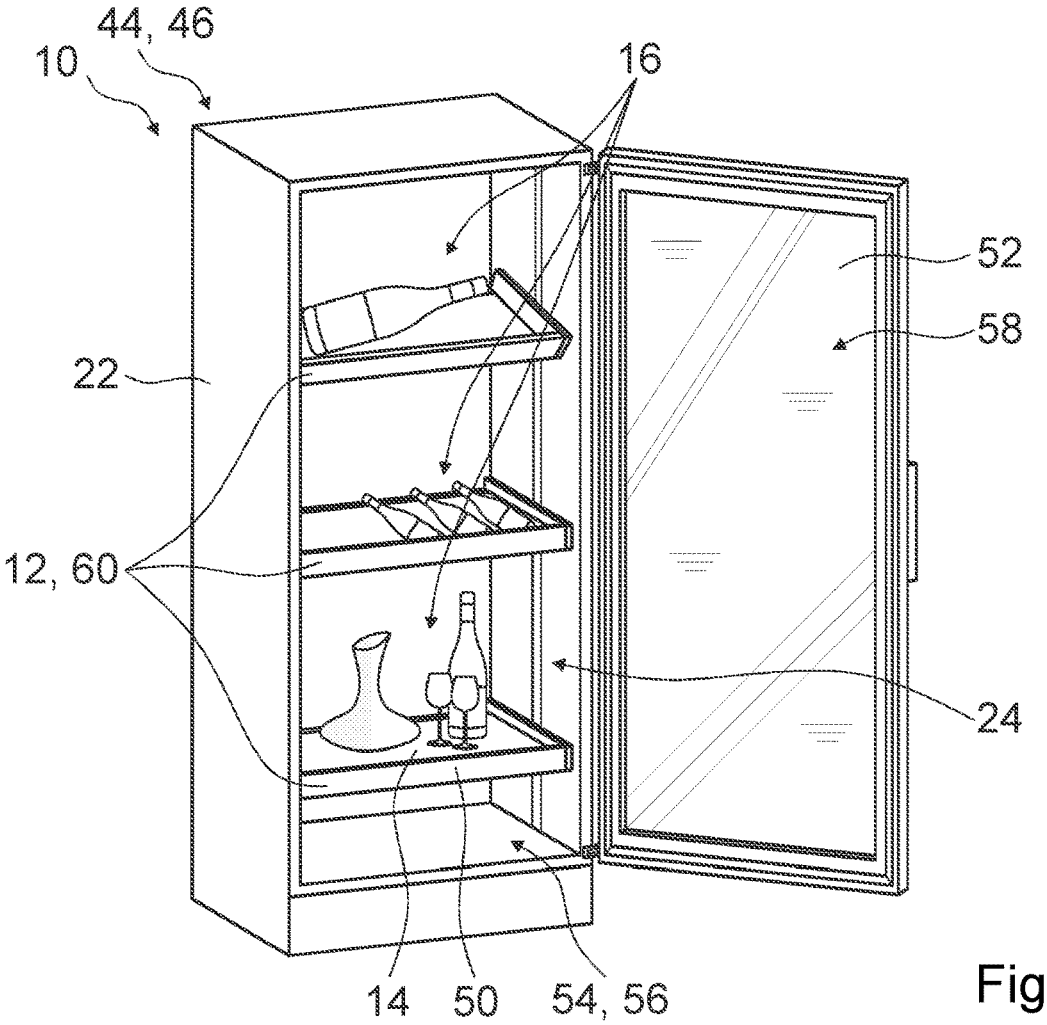
FIG. 1 is a diagrammatic, perspective side view of a household storage appliance configured as a wine storage cabinet with a household storage appliance apparatus.

Referring now to the figures of the drawings in detail and first, particularly, to FIG. 1 thereof, there is seen a household storage appliance 44. The household storage appliance 44 has a household storage appliance apparatus 10. The household storage appliance 44 is configured as a household refrigeration appliance. The household storage appliance 44 is configured as a wine storage cabinet 46. The household storage appliance 44 is provided to store and/or accommodate chilled goods and/or objects 16. The household storage appliance 44 is provided to store and/or accommodate wine bottles. The household storage appliance 44 can also be provided to cool chilled goods and/or objects 16. Alternatively the household storage appliance 44 could be provided to heat and/or keep objects 16 warm.

The household storage appliance apparatus 10 has an appliance body 22. The appliance body 22 defines a useful space 24. The useful space 24 can also be cooled. The household storage appliance apparatus 10 has an appliance door 52. The appliance door 52 delimits the useful space 24 on a front face 56 of the household storage appliance apparatus 10. The front face 56 is configured as an operating face 54. The appliance door 52 is disposed on the operating face 54 of the appliance body 22. The appliance door 52 has a transparent region 58 for the presentation of the objects 16 disposed in the useful space 24.

The household storage appliance apparatus 10 has a number of storage units 12, only one of which is described in more detail in the following. The storage unit 12 is disposed within the useful space 24. The storage units 12 are disposed one above the other in relation to an installation surface of the storage appliance 44. The storage unit 12 is held on the appliance body 22 in at least one operating state.

The storage unit 12 has a storage element 14. The storage element 14 is provided to hold at least one object 16. The objects 16 are disposed on the storage element 14 in the operating state. Wine bottles, wine glasses and/or decanters for example can be disposed on the storage element 14. The storage element 14 is configured as a tray 60.

Figure 2:
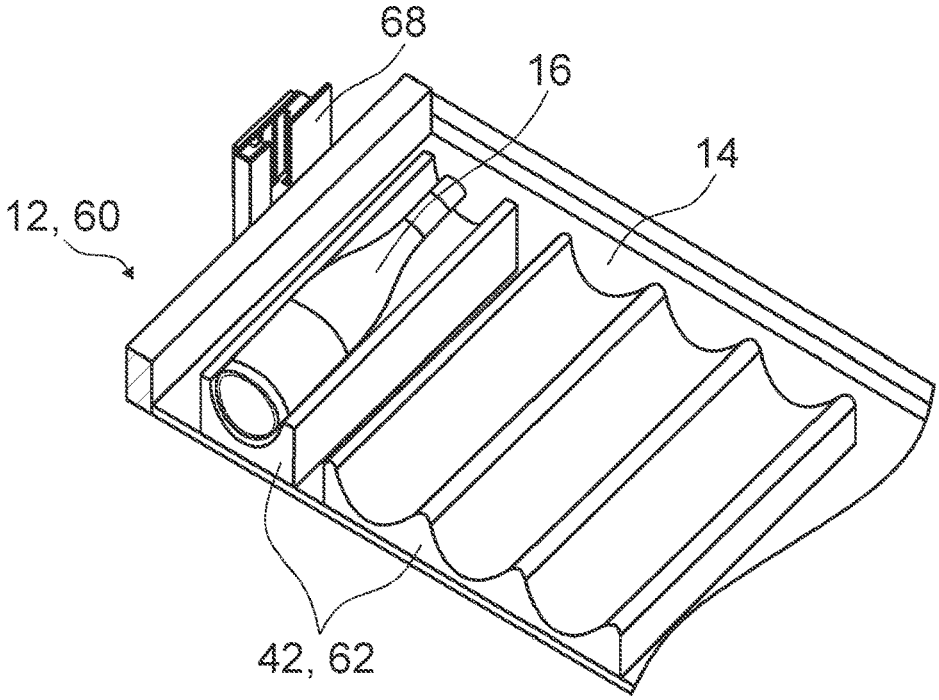
FIG. 2 is a fragmentary, perspective view of the storage unit with a functional overlay element of the household storage appliance apparatus.

The household storage appliance apparatus 10 can have a functional overlay element 42 (see FIG. 2). The overlay element 42 is configured as a bottle mat 62. Alternatively or additionally the overlay element 42 can be configured as a holding element for example for bottles, glasses and/or decanters. The functional overlay element 42 can be provided in at least one operating state to control the temperature of objects 16 disposed thereon. It is conceivable for the functional overlay element 42 to be provided to detect an object parameter and/or a status parameter, which reflects for example a storage time, wine type and/or allocation of the storage element 14 in the operating state. The functional overlay element 42 could be connected to a communication unit to transmit information to an internal and/or external function unit for the purposes of information acquisition and/or evaluation.

Figure 7:
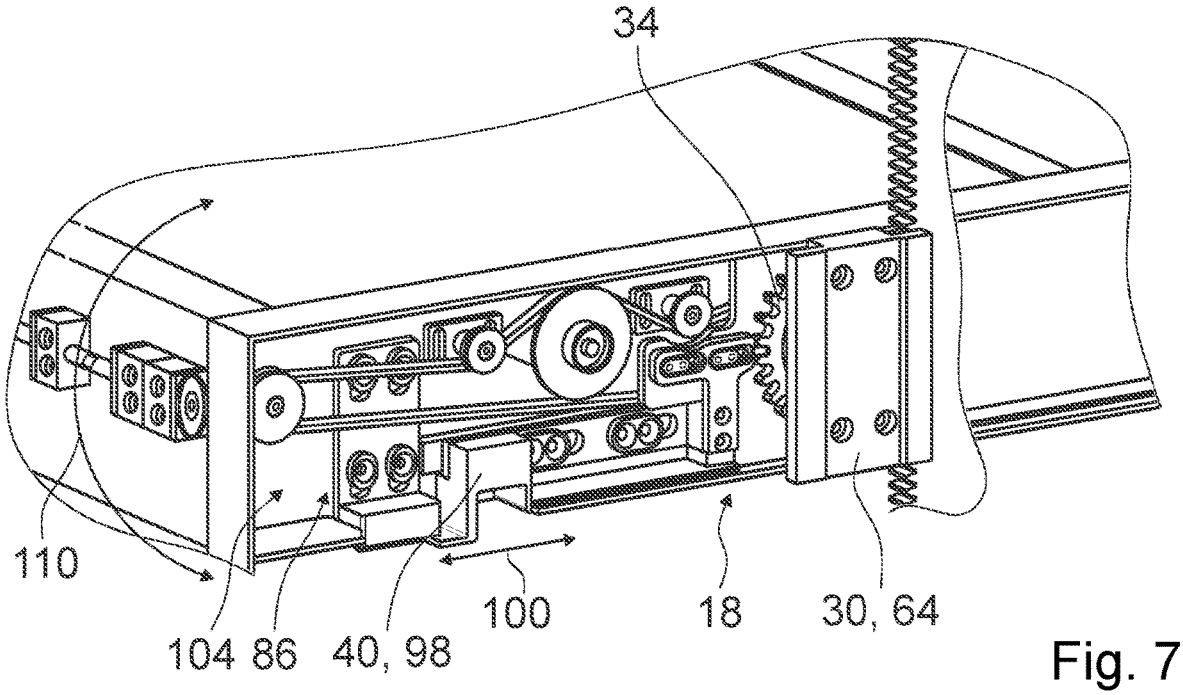
FIG. 7 is a fragmentary, perspective view of an inclination setting unit of the storage unit with a bearing unit.
Figure 8:
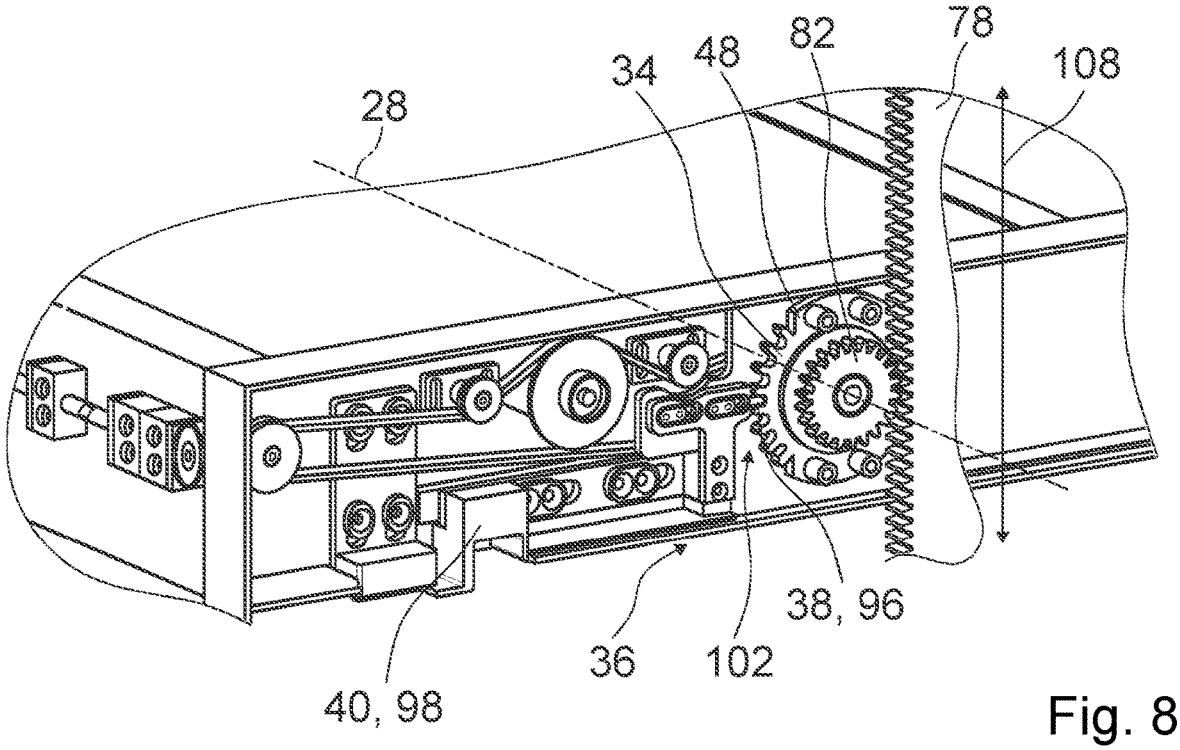
FIG. 8 is a view similar to FIG. 7 showing the bearing unit with a toothed wheel and a part of the side wall element with a toothed rack.

The storage unit 12 has an inclination setting unit 18 seen in FIGS. 7 and 8. The storage unit 12 has a further inclination setting unit. The inclination unit 18 and the further inclination unit are disposed on opposing sides of the storage unit 12. The inclination unit 18 and the further inclination unit are configured identically. Only the inclination unit 18 is described in more detail in the following.

Figure 3:
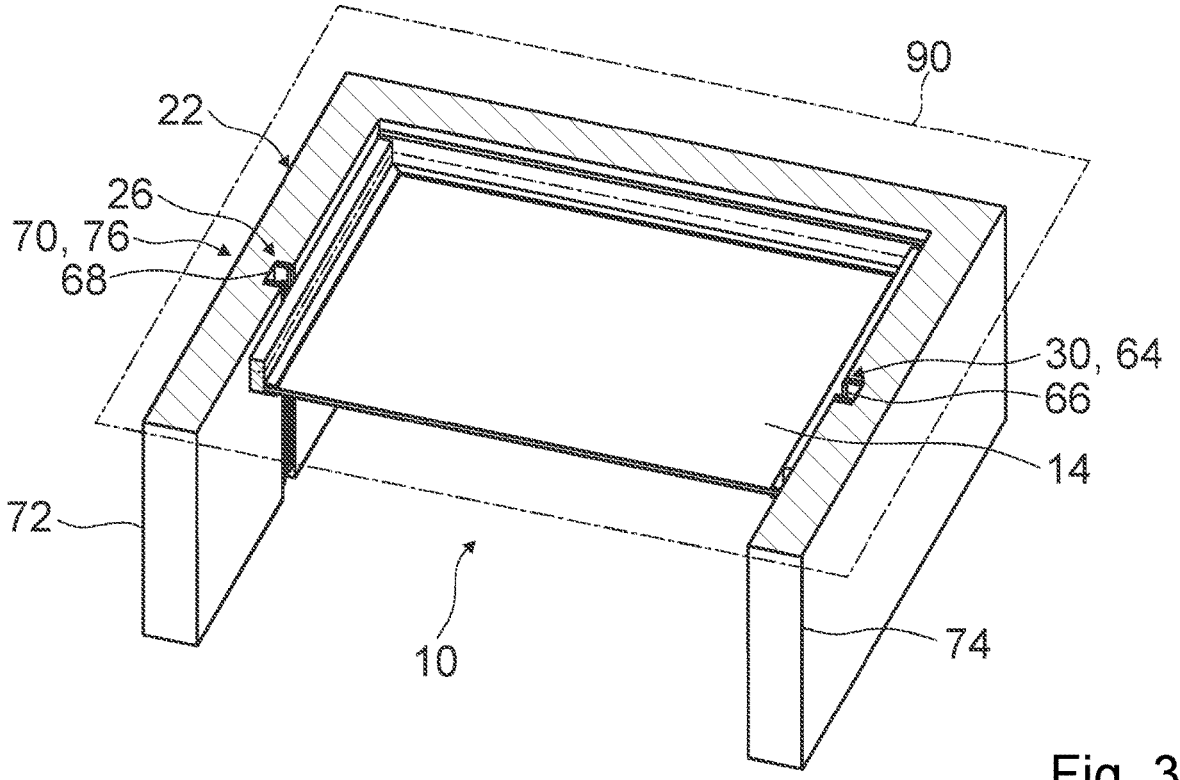
FIG. 3 is a horizontal-sectional view through an appliance body of the household storage appliance having the household storage appliance apparatus with a storage unit.

The inclination setting unit 18 has a bearing unit 26 (see FIGS. 3, 7 and 8). The bearing unit 26 supports the storage unit 12 on the appliance body 22 in the operating state.

The bearing unit 26 has a fastening element 30 (see FIG. 7). The bearing unit 26 has a further fastening element 70. The fastening element 30 and the further fastening element 70 are configured at least substantially identically. Only the fastening element 30 is described in more detail in the following. The fastening element 30 is provided to fasten the storage unit 12 to the appliance body 22. The fastening element 30 is configured as a T-shaped holder 64. The further fastening element 70 is configured as a further T-shaped holder 64. The appliance body 22 has a first rail 66. The appliance body 22 has a second rail 68. The rails 66, 68 are disposed on opposing side walls 72, 74 of the household storage appliance apparatus 10.

The fastening element 30 engages in the first rail 66. The further fastening element 70 engages in the second rail 68. The rails 66, 68 define a vertical movement direction 108 of the storage unit 12. The first rail 66 has a first toothed rack 78. The second rail 68 has a second toothed rack 80. The bearing unit 26 has a first toothed wheel 82 corresponding to the first toothed rack 78. The bearing unit 26 has a second toothed wheel 84 corresponding to the second toothed rack 80. The first and second toothed wheels 82, 84 are disposed on opposing sides of the storage unit 12. The first toothed wheel 82 is decoupled from the storage element 14 with respect to rotational movement. The second toothed wheel 84 is decoupled from the storage element 14 with respect to rotational movement. The first toothed wheel 82 is coupled to the storage element 14 with respect to translational movement. The second toothed wheel 84 is coupled to the storage element 14 with respect to translational movement.

The first toothed wheel 82 engages in the first toothed rack 78 with a form-locking connection. The second toothed wheel 84 engages in the second toothed rack 80 with a form-locking connection. The storage unit 12 can be moved by rotating the toothed wheels 82, 84. The storage unit 12 is supported in such a manner that it can be moved along the vertical movement path. The vertical direction is substantially perpendicular to a lower face of the appliance body 22 and/or to the installation surface.

The bearing unit 26 has a synchronization unit 86. The synchronization unit 86 is configured separately from the storage unit 12. The synchronization unit 86 is disposed on the storage unit 12. When the storage unit 12 moves vertically in the operating state, the synchronization unit 86 transfers a rotational movement of the first toothed wheel 82 at least substantially to a corresponding rotational movement of the second toothed wheel 84 or vice versa. The synchronization unit 86 has a connecting unit 104. In the operating state the connecting unit 104 couples the first toothed wheel 82 to the second toothed wheel 84 mechanically. When the storage unit 12 moves vertically in the operating state, the connecting unit 104 transfers a rotational movement of the first toothed wheel 82 to the second toothed wheel 84.

The storage unit 12 has a panel unit 50. The panel unit 50 is configured as a cover. The panel unit 50 is disposed on a side facing the user and on sides of the storage unit 12 facing the side wall 72, 74 of the appliance body 22. The panel unit 50 at least partially covers the synchronization unit 86. In FIGS. 7 and 8 a partial region of the panel unit 50, which conceals the synchronization unit 86, is not shown.

Figure 4:
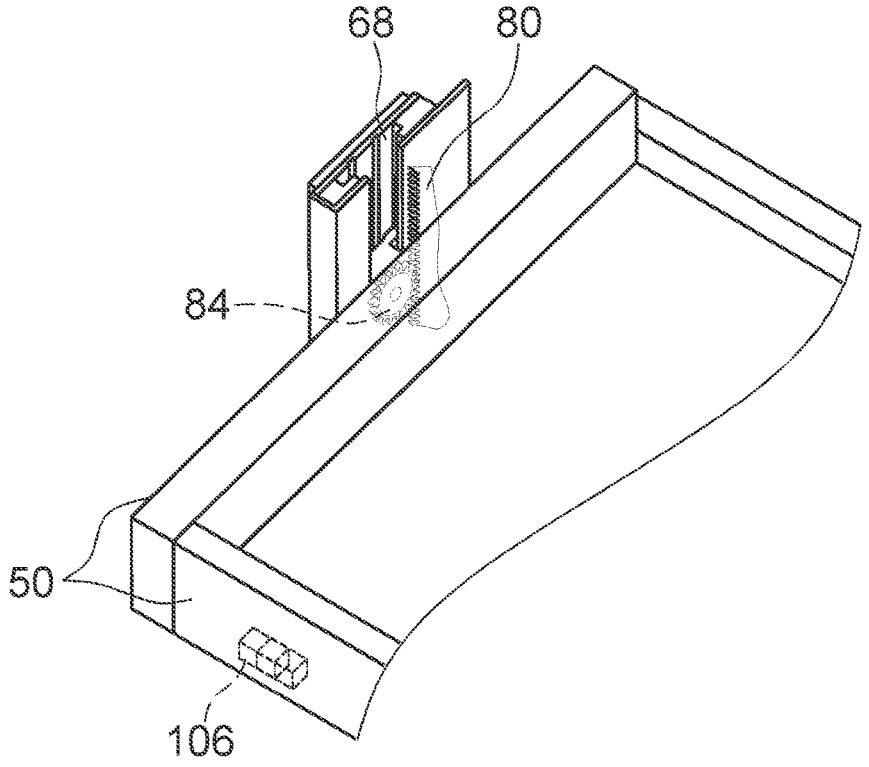
FIG. 4 is a fragmentary, perspective view of the storage unit with a fastening unit disposed on the appliance body.

The height of the storage unit 12 can be adjusted continuously by using the bearing unit 26. The height of the storage unit 12 is adjusted manually by an operator. The height of the storage unit 12 can be adjusted by the operator by pushing the storage unit 12 up and/or down. Alternatively the height of the storage unit 12 can be adjusted by using an electrical drive unit, by actuating a switch 106 (see FIG. 4). The bearing unit 26 defines a bearing axis 28. The bearing axis 28 runs horizontally through the first and second toothed wheels 82, 84. The bearing axis 28 can be disposed in different height positions on the appliance body 22 by using the fastening elements 30, 70.

The inclination setting unit 18 is provided to change at least one inclination 110 of the storage element 14 in relation to a horizontal 20. The storage element 14 is supported in such a manner that it can rotate about the bearing axis 28.

Figure 5:
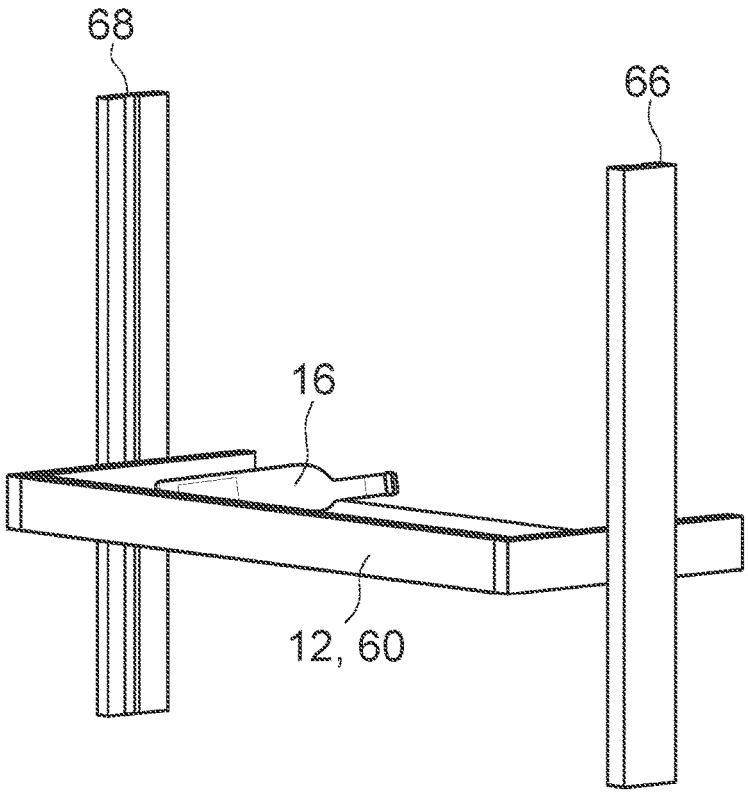
FIG. 5 is a perspective view of the storage unit disposed in rails of the appliance body with an object stored in a horizontal position on a storage element of the storage unit.
Figure 6:
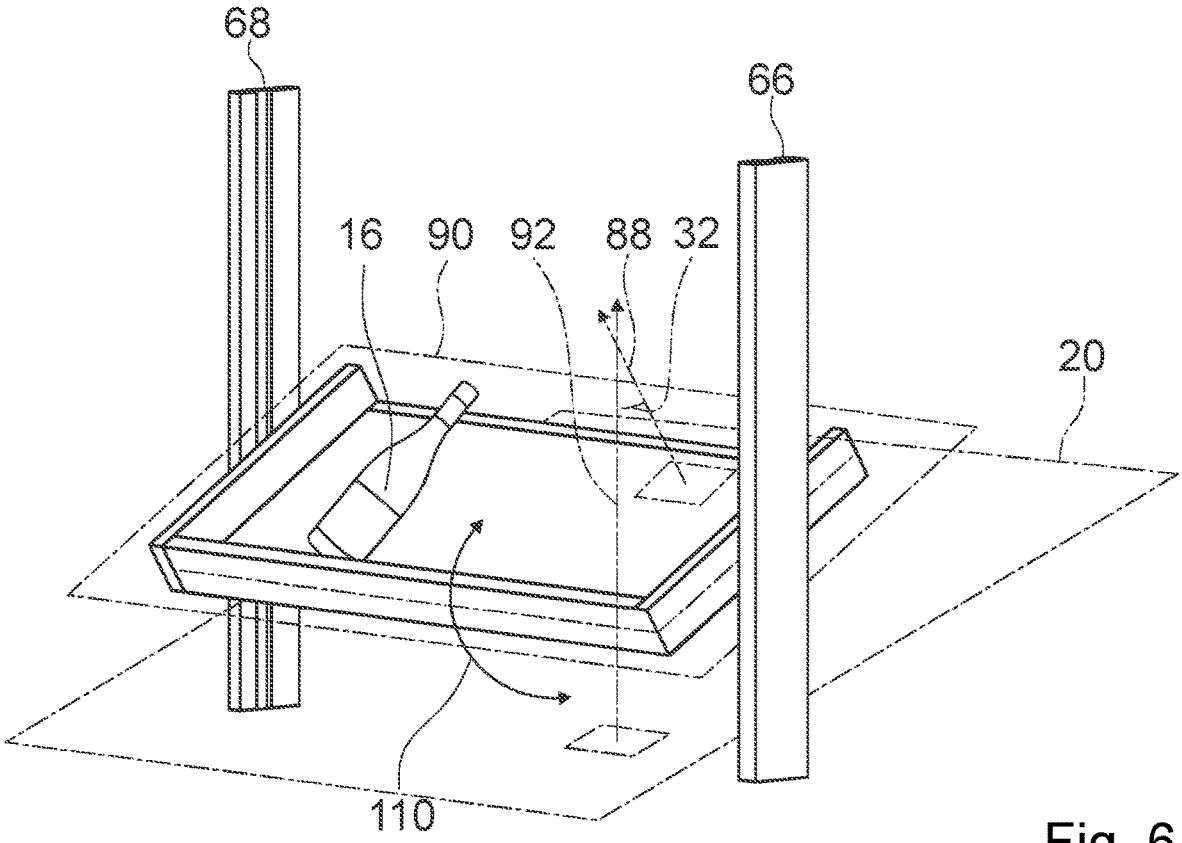
FIG. 6 is a view similar to FIG. 5 showing the storage unit disposed in rails of the appliance body with an object stored at an inclined position on the storage element of the storage unit.

The inclination setting unit 18 allows the setting of positive and negative angles of inclination 32 (see FIGS. 5 and 6). The angle of inclination 32 is formed by a surface normal 88 of the main extension plane 90 of the storage element 14 and a further surface normal 92 of the horizontal 20. The storage element 14 can be inclined toward and away from the operator.

The inclination setting unit 18 has an inclination setting element 48 (see FIG. 8). The inclination setting element 48 is provided to fix the angle of inclination 32 of the storage element 14. The inclination setting element 48 is connected to the storage element 14 in a rotationally fixed manner. The inclination setting element 48 is configured as disk-shaped. The inclination setting element 48 has a toothed wheel segment 34.

The inclination setting unit 18 has a fixing unit 36. The fixing unit 36 is provided to fix the storage element 14 at the angle of inclination 32. The fixing unit 36 interacts with the inclination setting element 48 in an operating state.

The fixing unit 36 has a form-locking element 38. The form-locking element 38 is provided to establish and/or cancel a form-locking connection. In an operating state the form-locking element 38 interacts with the inclination setting element 48. The form-locking element 38 is configured as a latching lug 96. In the operating state the latching lug 96 engages in a gap between the teeth of the toothed wheel segment 34, fixing the storage element 14 at an inclined position.

The fixing unit 36 has an operating element 40. The operating element 40 is connected to the form-locking element 38. The operating element 40 is configured as a grip 98.

The operating element 40 can be operated by a displacement movement. The displacement movement takes place in a direction 100. The operating element 40 has a rest position. In the rest position a form-locking connection 102 is established between the form-locking element 38 and the inclination setting element 48.

The operating element 40 has a deflection position. The operating element 40 can be deflected from the deflection position by using the displacement movement. In the deflection position the form-locking connection 102 between the form-locking element 38 and the inclination setting element 48 is canceled. In the deflection position it is possible to set an inclination 110 of the storage element 14. The displacement movement from the rest position to the deflection position takes place in the direction of the operator.

The fixing unit 36 has a reset element. In an operating state the reset element counteracts a displacement movement of the operating element 40. The reset element could be configured as a compression spring. Alternatively or additionally the reset element can have a different type of spring and be configured for example as a coil spring or tension spring.

The following is a summary list of reference numerals and the corresponding structure used in the above description of the invention:

10 Household storage appliance apparatus
12 Storage unit
14 Storage element
16 Object
18 Inclination setting unit
20 Horizontal
22 Appliance body
24 Useful space
26 Bearing unit
28 Bearing axis
30 Fastening element
32 Angle of inclination
34 Toothed wheel segment
36 Fixing unit
38 Form-locking element
40 Operating element
42 Overlay element
44 Household storage appliance
46 Wine storage cabinet
48 Inclination setting element
50 Panel unit
52 Appliance door
54 Operating face
56 Face
58 Region
60 Tray
62 Bottle mat
64 Holder
66 First rail
68 Second rail
70 Fastening element
72 Side wall
74 Side wall
76 Holder
78 First toothed rack
80 Second toothed rack
82 First toothed wheel
84 Second toothed wheel
86 Synchronization unit
88 Surface normal
90 Main extension plane
92 Surface normal
96 Latching lug
98 Grip
100 Direction
102 Form-locking connection
104 Connecting unit
106 Switch
108 Movement direction
110 Inclination

The invention claimed is:

1. A household storage appliance apparatus or household refrigeration appliance apparatus, comprising:

at least one storage unit;

said at least one storage unit having at least one storage element for receiving at least one object;

said at least one storage unit having inclination setting units for changing at least one inclination of said at least one storage element relative to a horizontal;

said inclination setting units each having a respective inclination setting element for fixing an angle of inclination of said at least one storage element, said inclination setting elements each being circular-disk-shaped and each having at least one toothed wheel segment;

first and second rails having respective toothed racks; and a bearing unit including first and second fastening elements each having a respective toothed wheel engaging in a respective one of said toothed racks, said toothed wheels defining a common bearing axis running through said toothed wheels and through said inclination setting elements.

2. The household storage appliance apparatus according to claim 1, which further comprises an appliance body defining a useful space, said at least one storage unit being held in said useful space, and said fastening elements fastening said at least one storage unit to said appliance body.

3. The household storage appliance apparatus according to claim 1, wherein said at least one storage element is rotatably supported about said common bearing axis.

4. The household storage appliance apparatus according to claim 1, wherein said fastening elements are configured to locate said common bearing axis in at least two different height positions on said appliance body.

5. The household storage appliance apparatus according to claim 1, wherein at least one inclination setting unit has at least one fixing unit for fixing said at least one storage element at said angle of inclination, said at least one fixing unit interacting with at least one inclination setting element in at least one operating state.

6. The household storage appliance apparatus according to claim 5, wherein said at least one fixing unit has at least one form-locking element for at least one of establishing or canceling a form-locking connection, said at least one form-locking element interacting at least partially with one inclination setting element in at least one operating state.

7. The household storage appliance apparatus according to claim 6, wherein said at least one fixing unit has an operating element connected to said at least one form-locking element.

8. The household storage appliance apparatus according to claim 7, wherein said at least one operating element is configured to be operated by a displacement movement in at least one direction.

9. The household storage appliance apparatus according to claim 8, wherein said at least one fixing unit has at least one reset element counteracting said displacement movement in at least one operating state.

10. The household storage appliance apparatus according to claim 1, wherein said at least one inclination setting unit is configured to set positive and negative angles of inclination of said at least one storage element.

11. The household storage appliance apparatus according to claim 1, which further comprises at least one functional overlay element configured to lay on said at least one storage element.

12. A household storage appliance or household refrigeration appliance or wine storage cabinet, comprising a household storage appliance apparatus according to claim 1.

13. The household storage appliance apparatus according to claim 1, which further comprises a synchronization unit for transferring a rotational movement of one of said toothed wheels to another of said toothed wheels during a vertical movement of said at least one storage unit.

14. The household storage appliance apparatus according to claim 13, which further comprises a single latching lug for engaging in a gap between two teeth of said at least one toothed wheel segment for fixing said at least one storage element at an inclined position.

* * * * *